US006675903B2

(12) United States Patent
Ohzeki et al.

(10) Patent No.: US 6,675,903 B2
(45) Date of Patent: Jan. 13, 2004

(54) BEACH CLEANER

(75) Inventors: Takashi Ohzeki, Saitama (JP); Yoshihiro Kimura, Saitama (JP); Yasuji Hashimoto, Saitama (JP); Yoshinobu Itani, Saitama (JP); Takashi Shinozaki, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 42 days.

(21) Appl. No.: 09/971,027

(22) Filed: Oct. 5, 2001

(65) Prior Publication Data

US 2002/0040794 A1 Apr. 11, 2002

(30) Foreign Application Priority Data

Oct. 6, 2000 (JP) ..... 2000-308498

(51) Int. Cl.[7] ..... B65F 3/00

(52) U.S. Cl. ..... 171/10; 171/105; 171/140; 171/143; 171/144; 171/11; 171/18

(58) Field of Search ..... 171/140, 84, 104, 171/105, 107, 111, 143, 144, 10, 11, 18

(56) References Cited

U.S. PATENT DOCUMENTS

| | | | | | |
|---|---|---|---|---|---|
| 1,549,870 | A | * | 8/1925 | Hamlin | |
| 3,979,146 | A | * | 9/1976 | Berg | 294/55 |
| 4,482,019 | A | * | 11/1984 | Murphy | 171/63 |
| 4,879,871 | A | * | 11/1989 | Kunschke et al. | 56/239 |
| 5,160,034 | A | * | 11/1992 | Potter | 209/38 |
| 5,417,044 | A | * | 5/1995 | Russo | 56/400.11 |
| 5,682,953 | A | * | 11/1997 | Buysse | 171/63 |
| 6,059,119 | A | * | 5/2000 | Davis | 209/233 |
| 6,330,920 | B1 | * | 12/2001 | Wanner | 171/19 |

FOREIGN PATENT DOCUMENTS

| | | | |
|---|---|---|---|
| DE | 2903205 | * | 8/1980 |
| DE | 2915826 | * | 11/1980 |
| EP | 0319420 A2 | * | 6/1989 |
| FR | 2265464 | * | 10/1975 |
| FR | 2559806 | * | 2/1984 |
| FR | 2576934 | * | 2/1985 |
| JP | 2-261111 | * | 10/1990 |
| JP | A 7-224413 | | 8/1995 |
| WO | WO 91/17318 | * | 11/1991 |

* cited by examiner

*Primary Examiner*—Christopher J. Novosad
(74) *Attorney, Agent, or Firm*—Birch, Stewart, Kolasch & Birch, LLP

(57) ABSTRACT

A beach cleaner for recovering waste while moving in a towed state by a traction vehicle. A grating-like portion scoops up waste present in front of the beach cleaner as the beach cleaner is moved and a reticulate portion that is formed behind the grating-like portion to hold waste. As the beach cleaner is moved, waste present in front of the beach cleaner is scooped up onto the grating-like portion and is held with the reticulate portion formed behind the grating-like portion. Sand that is scooped up together with the waste is allowed to drop through the gaps in the grating-like portion.

11 Claims, 13 Drawing Sheets

BEACH CLEANER

BACKGROUND OF THE INVENTION

CROSS-REFERENCE TO RELATED APPLICATIONS

The present application claims priority under 35 USC 119 to Japanese Patent Application No. 2000-308498 filed on Oct. 6, 2000 the entire contents thereof is hereby incorporated by reference.

1. Field of the Invention

The present invention relates to a beach cleaner for use in cleaning a sandy beach such as a bathing beach.

2. Description of Background Art

As a beach cleaner to be used for recovering empty cans, PET bottles and caps thereof, wooden pieces, etc. scattered on a sandy beach such as a bathing beach there is known a beach cleaner as disclosed in Japanese Patent Laid-open No. Hei 7-224413. This beach cleaner recovers waste while being towed by a traction vehicle. Sand is dug up together with waste by means of an excavating roller provided in a front position. Thereafter, the sand and the waste are delivered to a waste carrying section disposed on a rear side as the beach cleaner is moved. Then, in the waste carrying section, the waste and the sand are separated from each other and the waste is received in a waste receptacle portion.

There also is known a beach cleaner as disclosed in Japanese Patent Laid-open No. Hei 3-138203. In this beach cleaner, which is a self-traveling type, waste mixed in sand are scooped up together with the sand and are conveyed by means of a belt conveyor while sweeping away the sand to recover the waste.

In the beach cleaner disclosed in the above Japanese Patent Laid-open No. Hei 7-224413, an excavating roller for excavating sand together with waste is provided in a front position thereof and a waste carrying section for separating waste from sand thus excavated and receiving the separated waste is provided in a rear position thereof. This construction gives rise to a problem wherein the cleaner as a whole becomes large in size and the structure of the cleaner becomes complicated.

SUMMARY AND OBJECTS OF THE INVENTION

Accordingly, it is an object of the present invention to provide a beach cleaner that is small in size and simple in structure.

For achieving the above-mentioned object according to the present invention there is provided a beach cleaner for recovering waste while traveling in a towed state by a traction vehicle, e.g., a traction vehicle 11 used in an embodiment of the invention. The beach cleaner comprising a grating-like portion, e.g., a grating-like portion 22 used in the embodiment which scoops up waste present in front of the beach cleaner as the beach cleaner is moved. A reticulate portion, e.g., a reticulate portion 29 used in the embodiment, is formed behind the grating-like portion to hold waste.

Thus, the beach cleaner is provided with a grating-like portion which scoops up waste present in front of the beach cleaner as the beach cleaner is moved and is also provided with a reticulate portion which is formed behind the grating-like portion to hold waste. Thus, when front waste is scooped up by the grating-like portion as the beach cleaner is moved while being towed by the traction vehicle, the waste is delivered onto the grating-like portion and the sand also scooped up together with the wastes drops through gaps formed in the grating-like portion. The waste scraped up with the grating-like portion is held with a reticulate portion which is formed behind the grating-like portion.

According to the present invention there is provided a beach cleaner wherein a gap in the grating-like portion is set to be similar to a gap in the reticulate portion. Thus, since a gap in the grating-like portion is set to be similar to a gap in the reticulate portion, the waste scraped up with the grating-like portion can be held with the reticulate portion with reliability.

According to the present invention there is provided a beach cleaner wherein the gap in the grating-like portion is set at approximately 20 mm. Thus, since the gap in the grating-like portion is set at approximately 20 mm, it is possible to accurately recover empty cans, PET bottles and caps thereof, which are the largest in number as waste.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
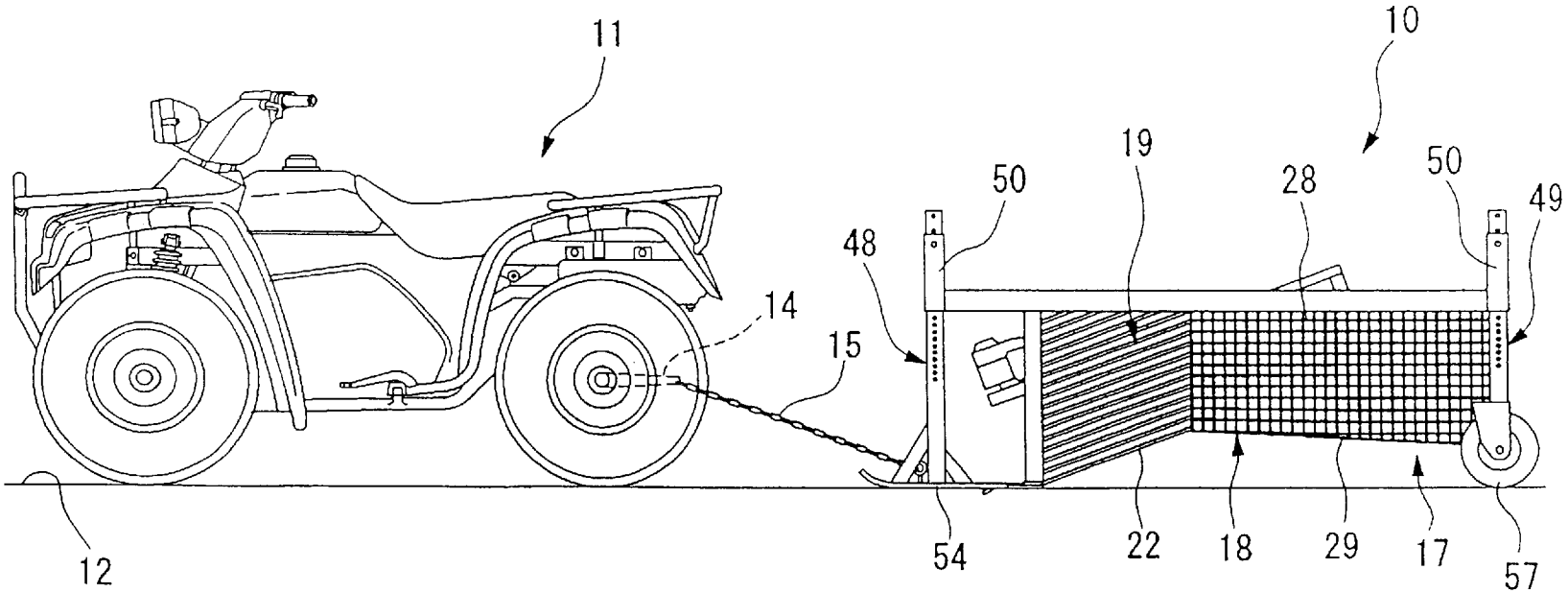
FIG. 1 is a side view showing a beach cleaner according to an embodiment of the present invention that is attached to a traction vehicle.
Figure 2:
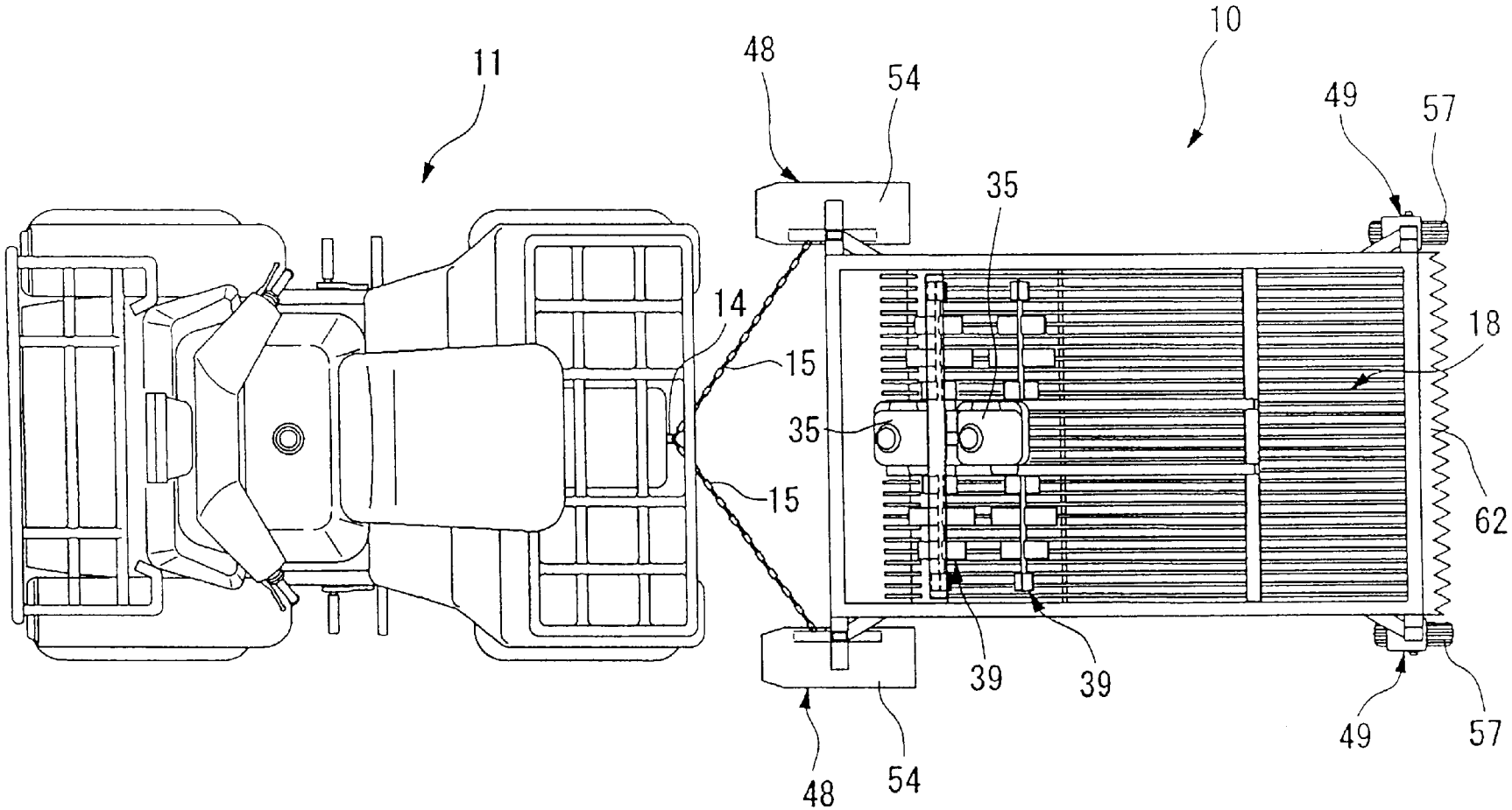
FIG. 2 is a plan view showing the beach cleaner according to the present invention that is attached to the traction vehicle.

A beach cleaner according to an embodiment of the present invention will be described hereinafter with reference to the drawings. As illustrated in FIGS. 1 and 2, the beach cleaner 10 of this embodiment recovers waste mixed in a sandy soil 12 while being towed by a traction vehicle 11.

The traction vehicle 11 is a saddle-ride type four-wheeled vehicle wherein one end of two chains 15 is connected to a traction member 14 which is fixed near an axle of a rear wheel, while opposite ends of the chains 15 are connected to the beach cleaner 10, for connecting the beach cleaner 10 to the vehicle 11. The opposite ends of the two chains 15 are connected to the beach cleaner 10 so that both chains are spaced from each other in the transverse direction of the vehicle and so that the rear position of the chains is lower than the forward position. The chains 15 are not specially limited. Connection members capable of being deformed in the front, rear, right and left directions are acceptable for connecting the beach cleaner 10 to the vehicle 11. For example, wires or the like may be used instead of the chains 15. The front and rear in the following description indicate front and rear in the traveling direction of the vehicle.

As shown in FIGS. 3 to 8, the beach cleaner 10 of this embodiment has a generally box-like recovery body 17 for the recovery of waste. The recovery body 17 has a bottom-forming portion 18 located approximately horizontally, side-forming portions 19 located on both ends in the transverse direction of the bottom-forming portion 18 and extending vertically and longitudinally of the vehicle body, and a rear-forming portion 20 located on a rear end of the bottom-forming portion 18 and extending vertically and transversely of the vehicle body.

Figure 3:
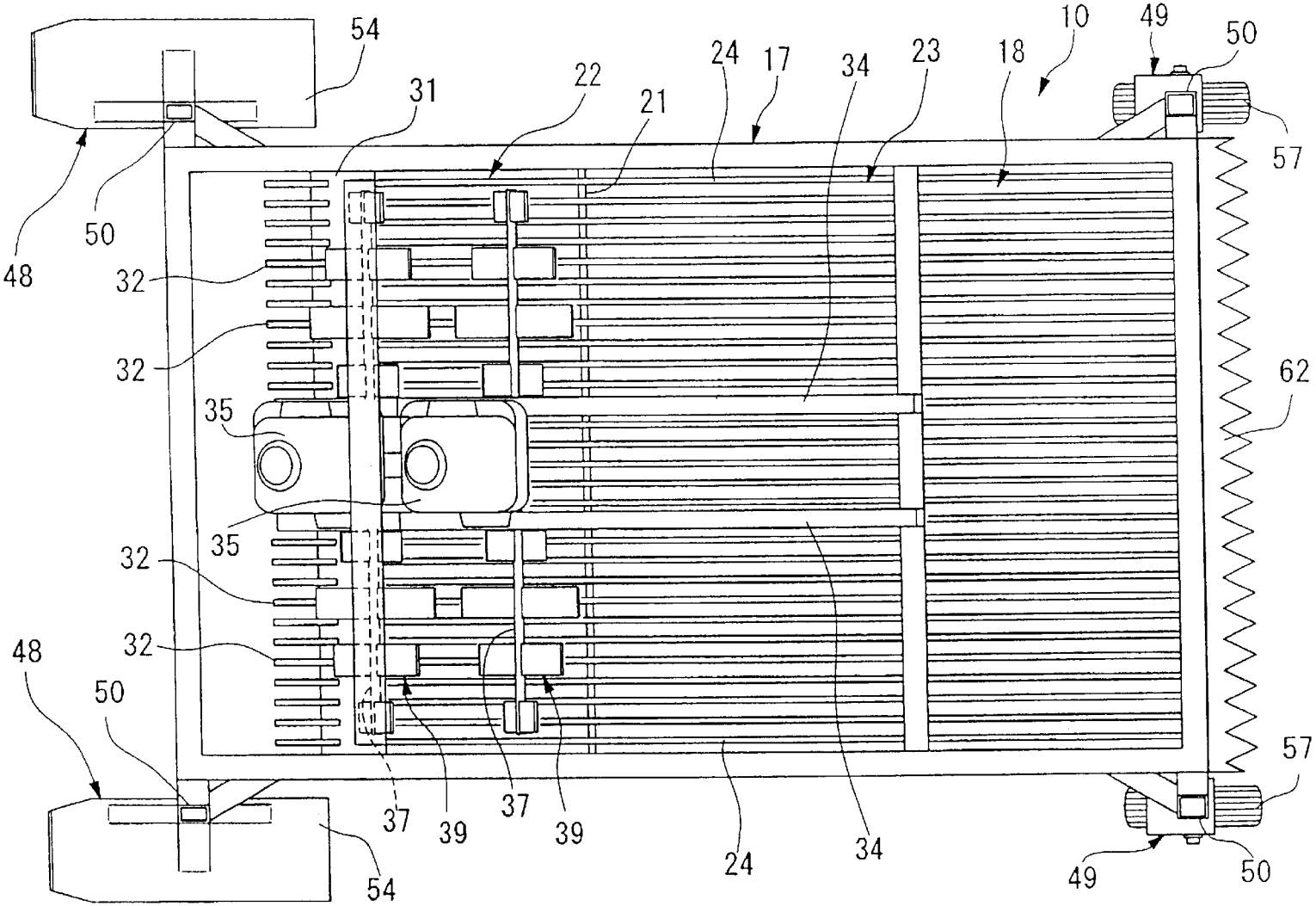
FIG. 3 is a plan view of the beach cleaner according to the present invention.
Figure 4:
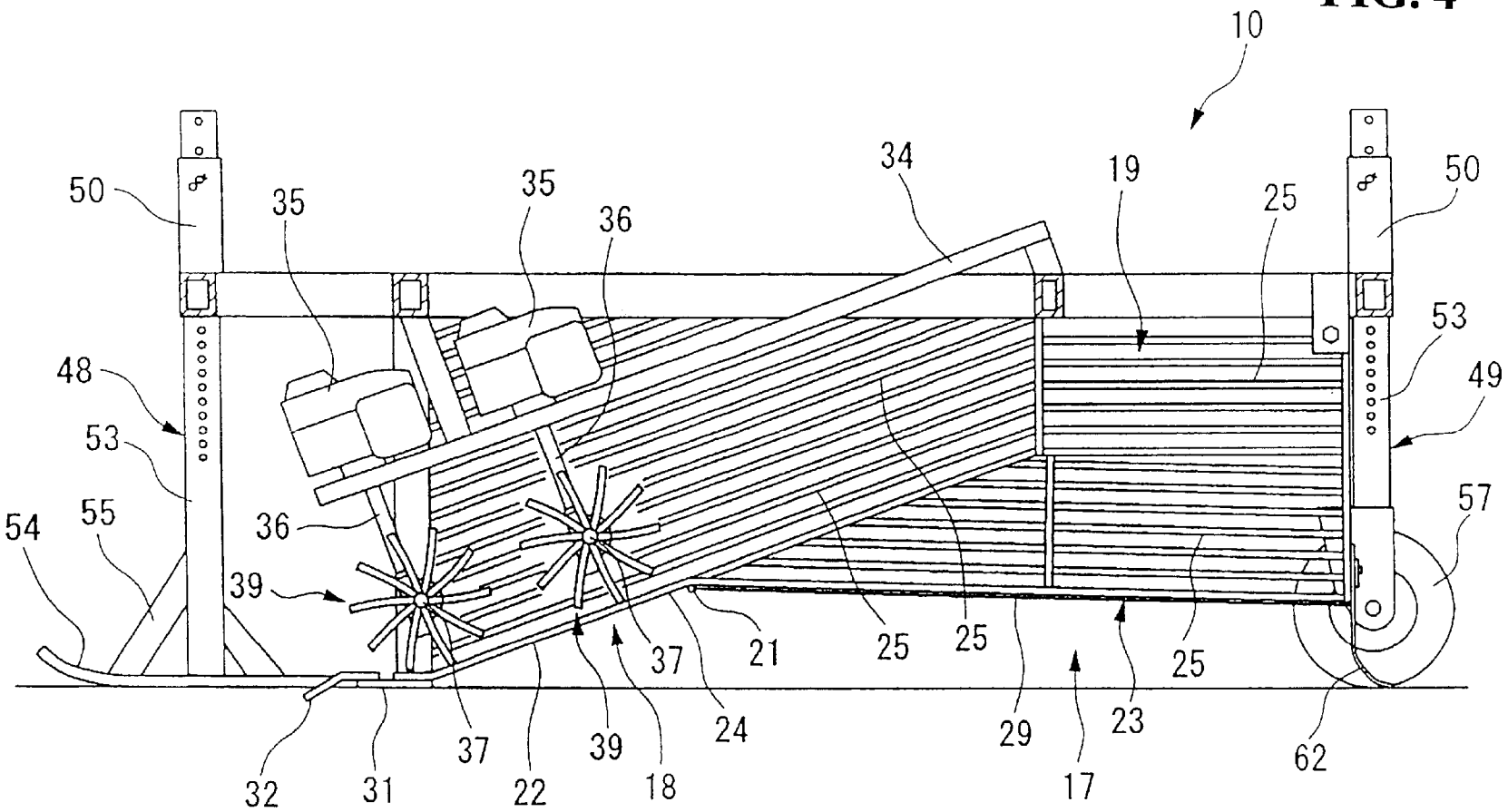
FIG. 4 is a side sectional side view of the beach cleaner according to the present invention.

As shown in FIGS. 3 and 4, the bottom-forming portion 18 has a grating-like portion 22 located in a front portion of the bottom-forming portion and is inclined so that the front side thereof assumes a lower position to scoop up waste from the front side, and a grating-like portion 23 extending rearwardly from a rear end position of the grating-like portion 22 and inclined so that the rear side thereof assumes a lower position. The grating-like portions 22 and 23 are constituted by a plurality of rods 24 made of iron, stainless steel, or aluminum, the rods 24 extending longitudinally while being bent at intermediate positions thereof and being arranged at equal intervals in the transverse direction of the vehicle body while allowing their bent portions to be supported by a support rod 21 extending in the transverse direction. The front and rear sides with respect to the support rod 21 serve as the grating-like portions 22 and 23, respectively. A gap spacing between adjacent rods 24 is set at approximately 20 mm. The angle of the front-side grating-like portion 22 relative to the horizontal plane is set larger than that of the rear-side grating-like portion 23 relative to the horizontal plane.

As shown in FIG. 4, both side-forming portions 19 include a plurality of rods 25 arranged approximately on an upper side of the front grating-like portion 22 and at equal intervals vertically in parallel with the grating-like portion 22 and a plurality rods 25 are arranged approximately on an upper side of the rear grating-like portion 23 and at approximately equal intervals and approximately parallel with the grating-like portion 23, providing a grating-like shape. Also in both side-forming portions 19, a gap spacing between adjacent and approximately parallel rods 25 is set at 20 mm or so.

Figure 5:
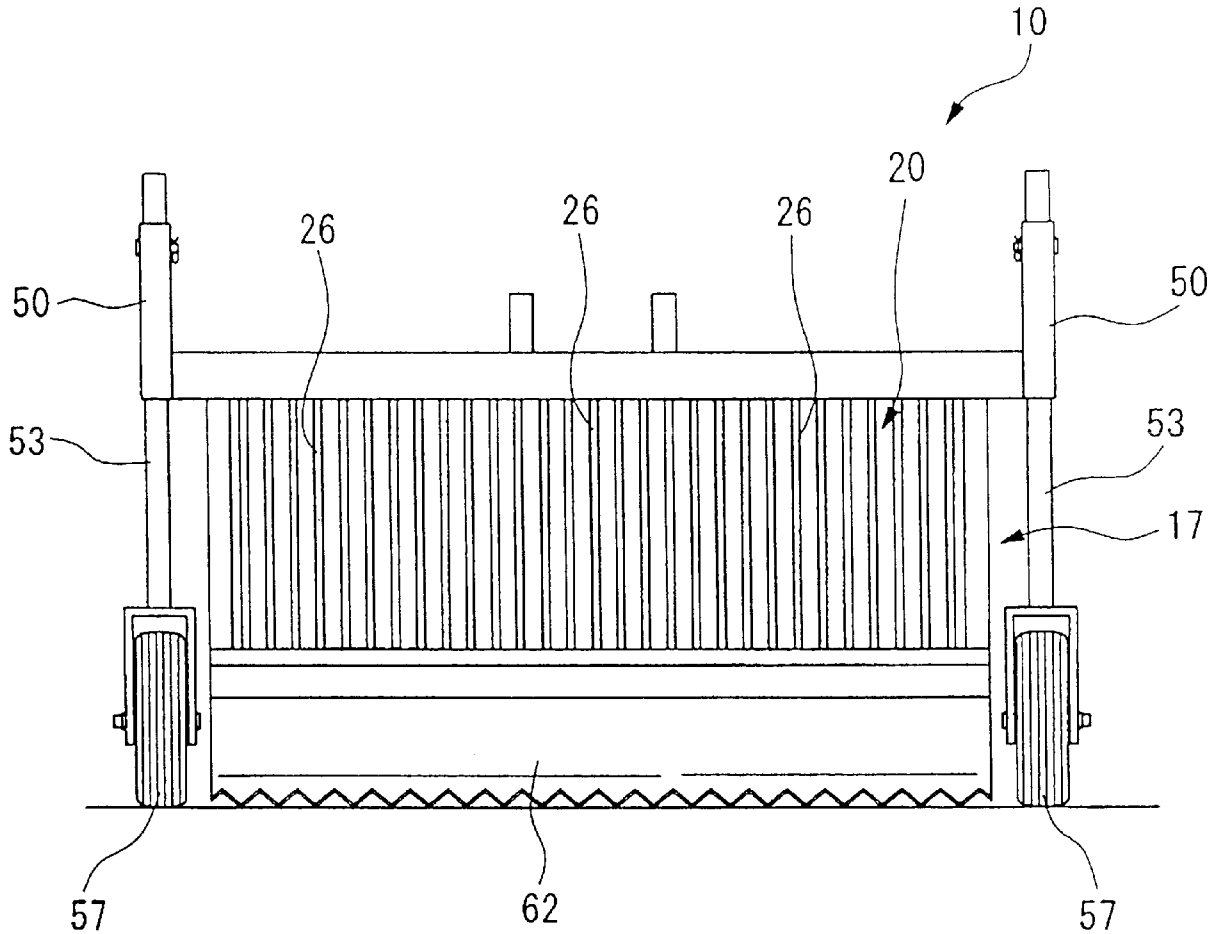
FIG. 5 is a rear view of the beach cleaner according to the embodiment of the present invention.

The rear-forming portion 20 has a plurality of rods 26 shown in FIG. 5, the rods 26 are arranged perpendicularly to the bottom-forming portion 18 and at equal intervals in the vehicular transverse direction, providing a grating-like shape. Also in the rear-forming portion 20, a gap spacing between adjacent rods 26 is set at approximately 20 mm.

Figure 6:
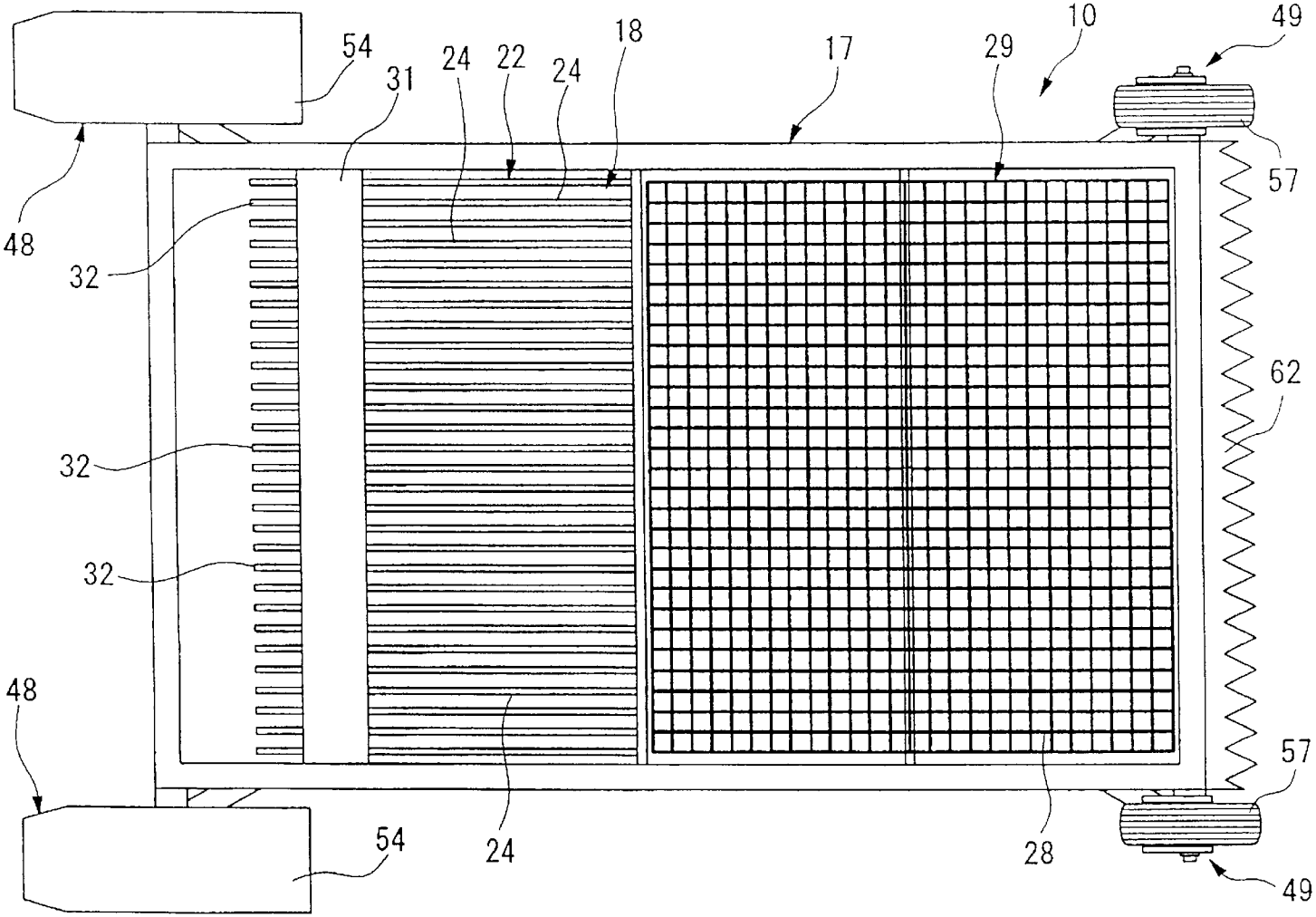
FIG. 6 is a bottom view of the beach cleaner according to the present invention.
Figure 7:
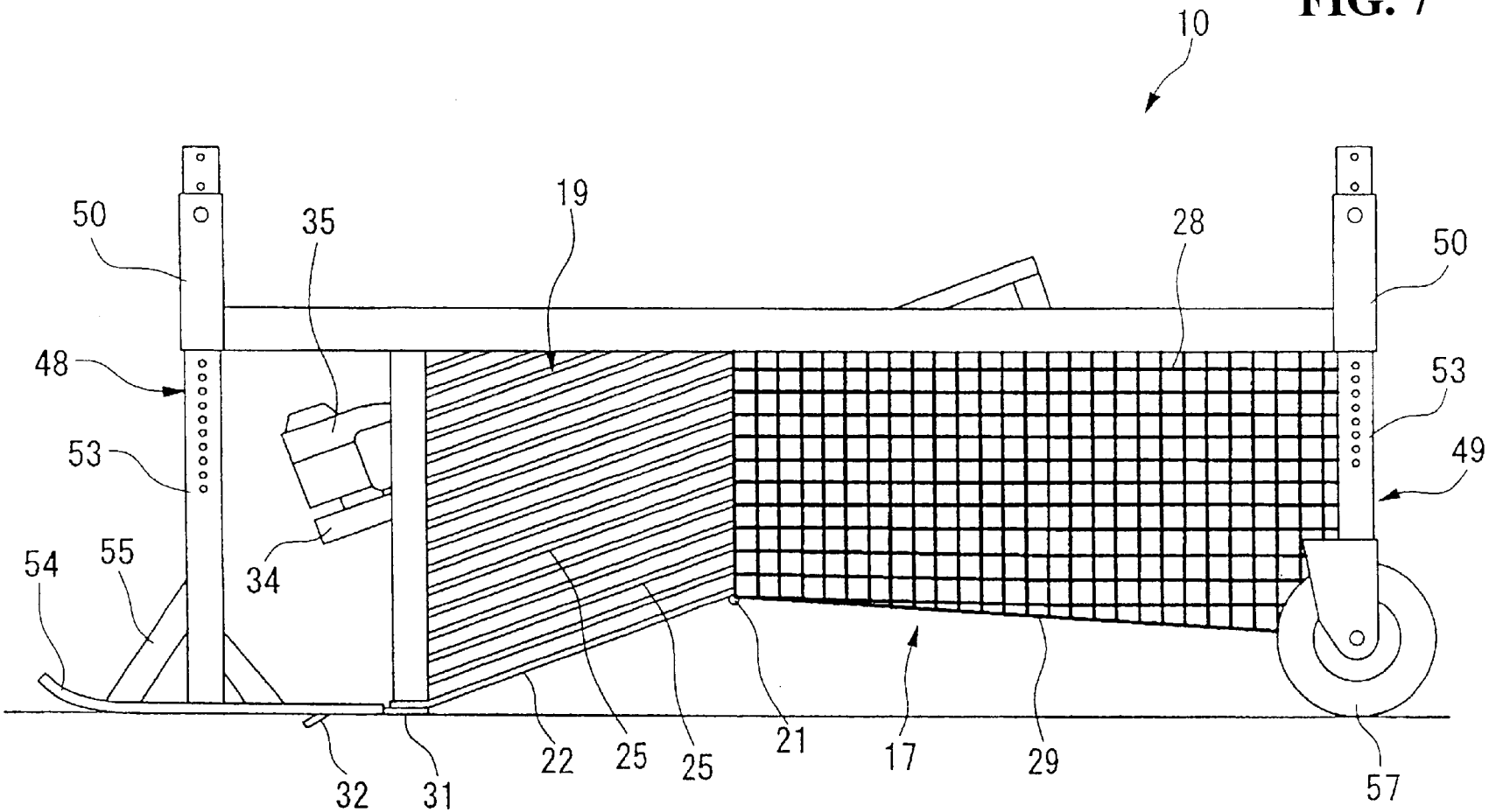
FIG. 7 is a side view of the beach cleaner according to the present invention.

As shown in FIGS. 6 and 7, a net 28 is stretched outside over an area so as to cover the entire underside of the rear grating-like portion 23 in the bottom-forming portion 18 and also cover both side-forming portions 19 located on the grating-like portion 23. With the net 28, a reticulate portion 29 is formed behind the front grating-like portion 22, the reticulate portion 29 being inclined so that the rear side thereof is located at a lower position to hold waste. The gap spacing in the reticulate portion 29 is set approximately equal to the gap spacing between adjacent rods in the grating-like portion 23. The angle of the reticulate portion 29 relative to a horizontal plane, which angle is equal to that of the rear grating-like portion 23, is set smaller than the angle of the front grating-like portion 22 relative to the horizontal plane. The net 28 may be further stretched so as to cover the rear-forming portion 20.

Without stretching the net 28 over the rear grating-like portion 23, the portion behind the front grating-like portion 22 may be constituted directly by a net. Further, both side-forming portions 19 located on the rear grating-like portion 23 may be constituted directly by a net. Additionally, the rear-forming portion 20 may be constituted directly by a net.

Figure 8:
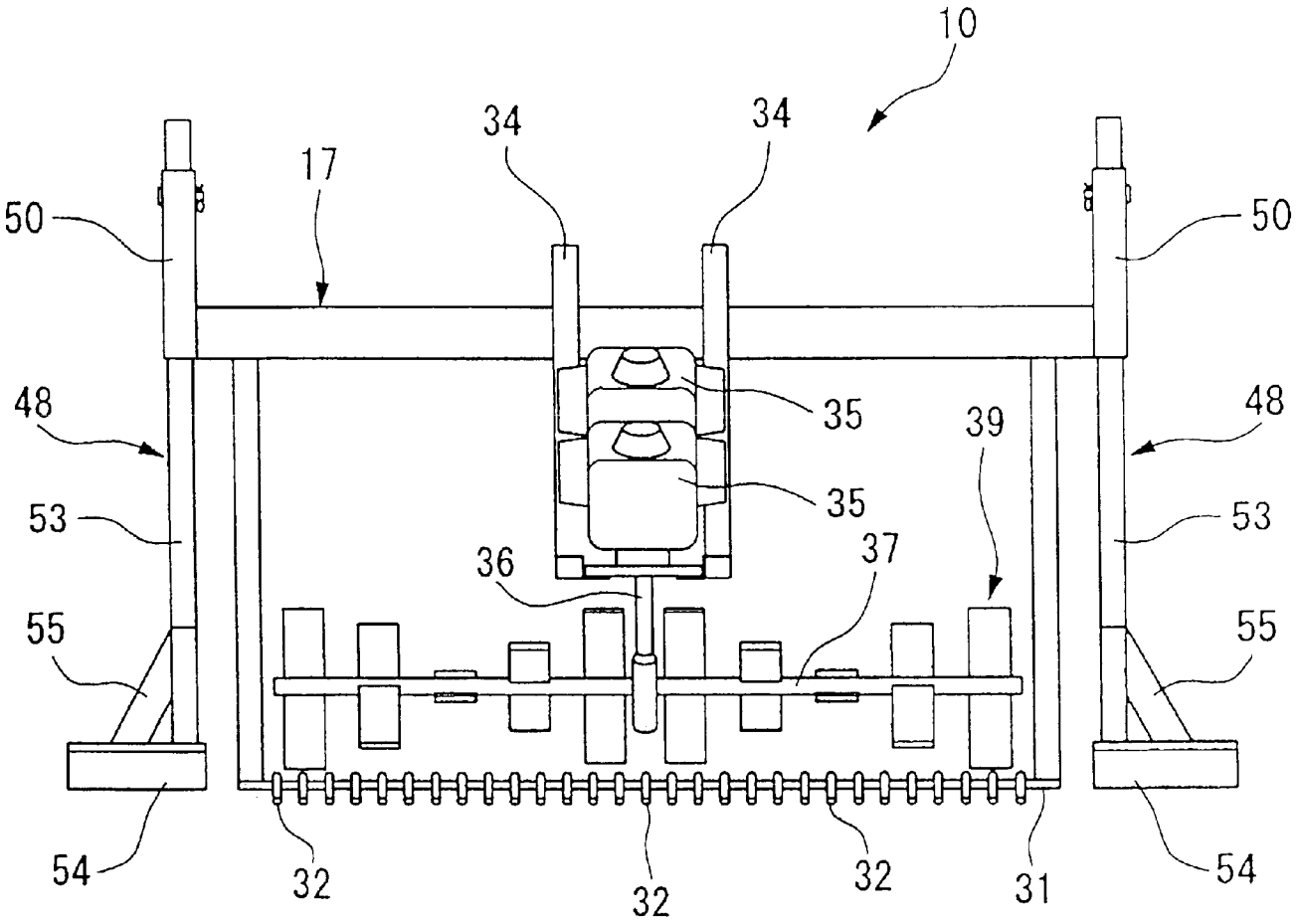
FIG. 8 is a front view of the beach cleaner according to the present invention.

As shown in FIGS. 3, 4, and 8, a front portion of the front grating-like portion 22 in the bottom-forming portion 18 is constituted as a connecting plate portion 31 extending in the vehicular transverse direction nearly horizontally, and front ends of all the rods 24 are fixed to the connecting plate portion 31. Further, a plurality of rod-like pawl members 32 are fixed to the connecting plate portion 31, the pawl members 32 are arranged in parallel at equal intervals in the vehicular transverse direction and project forward while being inclined so that the respective front sides are positioned lower than their rear sides.

As shown in FIGS. 3 and 4, two support members 34 are arranged centrally in the vehicular transverse direction on the upper side of the front grating-like portion 22 and in parallel with the front grating-like portion, and two internal combustion engines 35 of the same shape are secured to the support members 34 in the front and rear positions, respectively, so as to match the inclination of the grating-like portion 22. The internal combustion engines 35 have respective extending portions 36 extending toward the grating-like portion 22. Further, rotary shafts 37 are provided respectively at lower positions of the extending portions 36, the rotary shafts 37 extending in the vehicular transverse direction up to a position near both side-forming portions 19. The rotary shafts 37 are rotated by the internal combustion engines 35.

The rotary shafts 37 constitute portions of rotors 39 which are disposed on the upper side of the front grating-like portion 22 and which are adapted to rotate centered on the rotary shafts 37 so that their lower portions move rearwardly, thereby causing waste to be sent out rearwardly between the rotors and the grating-like portion 22.

Figure 9:
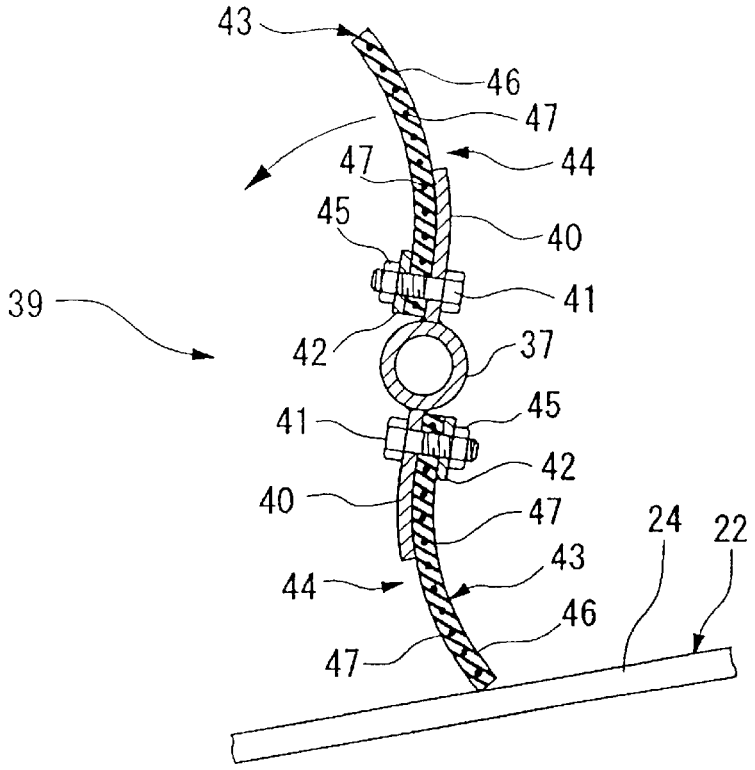
FIG. 9 is a side sectional side view showing a part of a rotor used in the beach cleaner according to the present invention.
Figure 10:
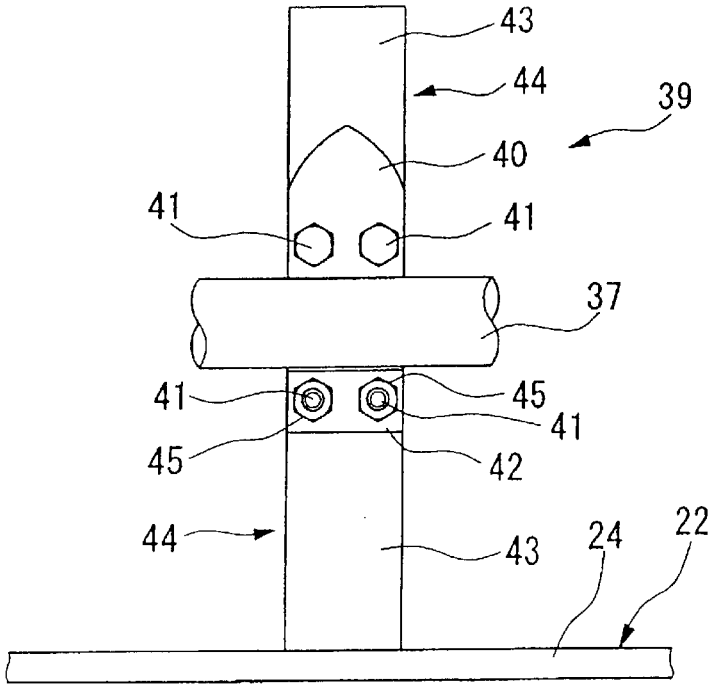
FIG. 10 is a front view showing a part of the rotor used in the beach cleaner according to the present invention.

More specifically, as shown in FIGS. 9 and 10, each rotor 39 has rotary portions 44, the rotary portions 44 each comprising a rigid member 40 including a steel plate and fixed to the associated rotary shaft 37, a bolt 41 inserted into the rigid member 40, a support plate 42 including a steel plate, the support plate 42 being connected to the rigid member 40 by bringing the bolt 41 into threaded engagement with a fixed nut 45, and an elastic member 43 which is sandwiched in between and fixed to the rigid member 40 and the support plate 42 by tightening the bolt 41 and nut 45.

The rotor 39 is constituted by arranging a plurality of sets of the rotary portions 44, each set comprising a pair of rotary portions 44 extending in directions opposite to each other at the same position in the axial direction. Plural sets of rotary portions 44 are arranged at equal pitches in the axial direction of the rotary shaft 37 and with different phases so as to be displaced gradually in their positions in the rotational direction. More specifically, as shown in FIGS. 3 and 8, on each of both side portions of the rotary shaft 37 centered at the internal combustion engines 35 are provided a plurality of sets (five sets) of rotary portions 44. The plurality of sets of rotary portions 44 are arranged so as to be angularly displaced approximately at equal angles by dividing 360° equally in the same direction successively from one side in the axial direction.

As shown in FIGS. 9 and 10, the elastic member 43 which constitutes each rotary portion 44 is in a generally rectangular shape and is fixed by both rigid member 40 and support plate 42 at one longitudinal end portion, thereby constituting a radially outer side of the rotor 39. The elastic member 43 comprises rubber 46 and a reinforcing core member 47 formed of a synthetic fiber or a metal and incorporated in a lattice-shape within the rubber 46. The elastic member 43 is curved so that its radially outer side is curved so as to be positioned on a front side in the rotational direction. The elastic member 43 has a length which, when positioned closest to the grating-like portion 22, forms a little gap between the elastic member and the grating-like portion 22.

The rigid member 40 which constitutes each rotary portion 44 has a length about one-third of the length of the elastic member 43 and is curved to match the shape of the elastic member 43 so that its radially outer side is position on the front side in the rotational direction. On a radially inner side of the rotary portion 44, one end portion of the elastic member 43 is supported from a rear side in the rotational direction of the rotary portion 44.

The rotor 39 of the above configuration is disposed for each of the two internal combustion engines 35. As a result, plural rotors 39 are disposed on the upper side of the grating-like portion 22 so as to be displaced longitudinally and in conformity with the inclination of the grating-like portion 22 (in such a manner that a line jointing the centers of the plural rotors 39 is parallel to the grating-like portion 22).

Both internal combustion engines 35 can be mounted removably to the support members 34 and are slidable with respect to the support members 34. The positions where the internal combustion engines 35 are to be fixed can be set to any positions on the support members 34, depending on the quality of sand for example. But this positional adjustment is made mainly for the internal combustion engine disposed behind the front-side engine. As to the front-side internal combustion engine 35, it is preferably disposed at an approximately constant position at which the rotary shaft 37 thereof is located substantially just above the connecting plate portion 31.

On both transverse sides of the front and rear ends of the recovery body 17 constructed as above are mounted support/travel portions 48 and 49 which support the recovery body 17 and which are adapted to travel in contact with sandy soil 12.

Figure 11:
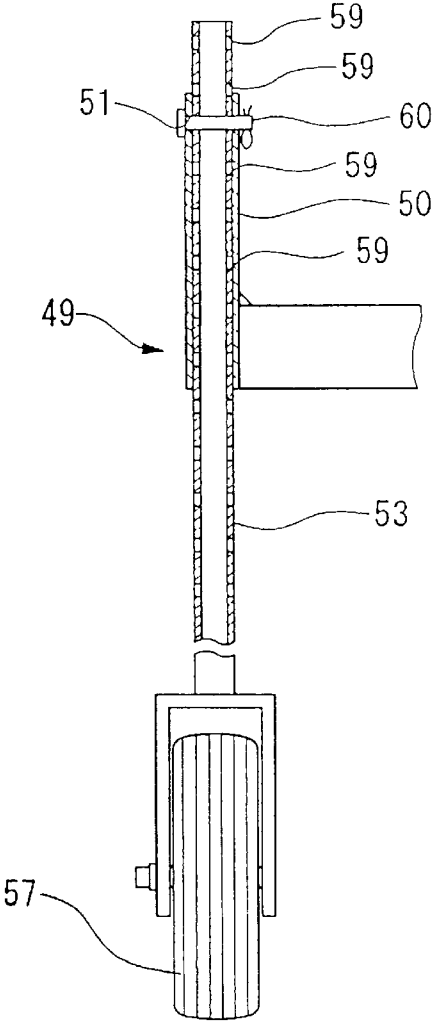
FIG. 11 is a partially sectional front view showing a support/travel portion, etc. in the beach cleaner according to the present invention.
Figure 12:
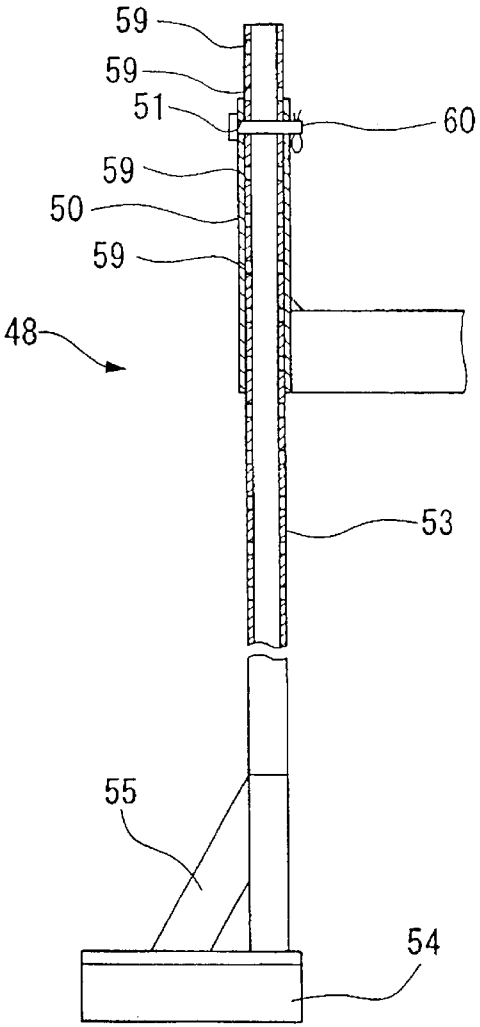
FIG. 12 is a partially sectional front view showing another support/travel portion, etc. in the beach cleaner according to the present invention.

More specifically, as shown in FIG. 3, prismatic mounting members 50 are fixed to four front, rear, right and left corners of the recovery body 17 so as to be open up and down, and as shown in FIGS. 11 and 12, through holes 51 are formed in the mounting members 50 respectively at the same vertical position so as to extend through the mounting members in the vehicular transverse direction.

As shown in FIG. 7, etc., the support/travel portions 48 attached to the front mounting members 50 are each provided with a prismatic support post portion 53 inserted into the associated mounting member 50. A ski-like portion 54 is formed as a plate portion fixed horizontally to a lower end portion of the support post portion 53. A reinforcing portion 55 is provided for reinforcing the fixed state between the support post portion 53 and the ski-like portion 54. A front end of the ski-like portion 54 is curved so as to be inclined forwardly and upwardly. The two chains 15 for connecting the beach cleaner to the traction vehicle 11 are connected to the ski-like portions 54, respectively.

The support/travel portions 49 attached respectively to the rear mounting members 50 are each provided with, as shown in FIG. 11, the same support post portion 53 as above which is inserted into the associated mounting member 50 and a wheel 57 supported by a lower end of the support post portion 53 so as to be rotatable around a horizontal axis. The wheel 7 is mounted so that a rotational axis thereof extends always in the vehicular transverse direction.

As shown in FIGS. 11 and 12, in the support post portion 53 of each of the support/travel portions 48 and 49, a plurality of through holes 59 are formed at equal pitches in the vertical direction so as to extend through the support post portion 53 in the vehicular transverse direction. By inserting a pin 60 into any of the through holes 59 formed in the support post portion 53 and also into the through hole 51 formed in the mounting member 50 each support/travel portion 48 (49) is fixed to the mounting member 50. By pulling out the pin 60 the support/travel portion 48 (49) becomes free relative to the mounting member 50 and thus can be removed that is, the support/travel portions 48 and 49 can be attached to and detached from the mounting members 50 of the recovery body 17.

With the pins 60 pulled out, the support post portions 53 are displaced vertically with respect to the mounting members 50 to adjust the height of the support/travel portions 48 and 49 relative to the recovery body 17, then the pins 60 are inserted into through holes 59 in the support post portions 53 and also into the through holes 51 in the mounting members 50 which holes 59 and 51 have become aligned as a result of the adjustment, to fix the support/travel portions 48 and 49 to the recovery body 17. In this way the height of the support/travel portions 48 and 49 relative to the recovery body 17 is adjusted that is, the support/travel portions 48 and 49 can be adjusted in height relative to the recovery portion 17.

As shown in FIGS. 3 to 6, a finishing member 62 is fixed on the rear side of the rear-forming portion 20 of the recovery body 17, i.e., at the rearmost end of the recovery body 17, to level the sandy soil 12 as the beach cleaner is moved along the beach. The finishing member 62 extends in the vehicular transverse direction. The finishing member 62 includes an elastic member such as a rubber plate that is curved so that its lower side is positioned rearwardly. A lower end of the finishing member 62 is formed in a saw-notched shape including a large number of notches arranged continuously in the vehicular transverse direction, whereby groove patterns of a uniform depth are drawn on the sandy soil 12. The shape of the lower end of the finishing member 62 is not limited to such a saw-notched shape, but may be a corrugated or convex-concave shape. In any case, the arrangement pitch of such chevrons or the like may be changed.

Both front and rear rotors 39 are turned ON by operating both internal combustion engines 35 and the beach cleaner 10 of this embodiment is allowed to travel by being towed with the traction vehicle 11. As the beach cleaner 10 travels, the plurality of pawl members 32 provided at the front end of the grating-like portion 22 engage the sandy soil 12 and scrape up waste present on or somewhat buried in the sandy soil, the waste is scooped up onto the grating-like portion 22 contiguous to the pawl members 32 with the energy of the travel. The waste thus scooped up onto the grating-like portion 22 is delivered rearwardly together with sand by means of the front rotor 39. At this time, only the waste passes through between the rotor 39 and the grating-like portion 22 and is sent out rearwardly while climbing the slant of the grating-like portion. As to the sand, it drops onto the sandy soil 12 through the gaps in the grating-like portion 22 and further through a generally triangular space defined by the grating-like portion 22, the reticulate portion 29 and the sandy soil 12. Then, the waste that is sent out rearwardly along the grating-like portion 22 by the front rotor 39 and is thereby separated from the sand is further passed between the rear rotor 39 and the grating-like portion 22 with the rotation of the rear rotor and is sent out rearwardly while climbing the slant of the grating-like portion 22. The waste reaches the reticulate portion 29 whose rear side is inclined downwardly and is held by the reticulate portion.

The sandy soil 12 including the sand scraped up by the pawl members 32 and dropped from the grating-like portion 22 is lastly leveled by the finishing member 62 disposed at the rear end of the beach cleaner 10.

Thus, the beach cleaner 10 of this embodiment has a plurality of pawl members 32 arranged to be spaced in the vehicular transverse direction and projecting forwardly while the front side is lowered in position. The grating-like portion 22 is inclined so that the front side thereof is lower in position to scoop up waste present in front of the beach cleaner as the beach cleaner is moved. The rotors 39 are disposed on the upper side of the grating-like portion 22 to send out waste rearwardly through between the rotors and the grating-like portion. The reticulate portion 29 is disposed behind the grating-like portion 22 and includes a rear side that is lower in position to hold waste. Therefore, as the air cleaner 10 travels while being towed by the traction vehicle 11, the pawl members 32 engage the sandy soil 12 and scrapes up waste, allowing the waste to be scooped up onto the grating-like portion 22. Thus, the waste is delivered onto the grating-like portion 22, while sand which is scooped up together with the waste drops through the gaps in the grating-like portion. The waste which is delivered onto the grating-like portion 22 is sent out rearwardly through between the plurality of rotors 39 and the grating-like portion 22 by means of the rotors arranged on the grating-like portion and are held by the reticulate portion 29.

With such a configuration wherein waste is sent out to the rear reticulate portion 29 by the rotors 39 while being separated from sand by the grating-like portion 22 which is inclined so as to be lower on its front side, the beach cleaner can be reduced in size and simplified in structure. In addition, since the reticulate portion 29 is inclined so as to be lower on its rear side, the waste held therein does not move to the front grating-like portion 22, thus permitting the waste to be held positively. Moreover, since the pawl members 32 engage the sandy soil 12 and scrape up waste, allowing the waste to be scooped up onto the grating-like portion 22, it is possible to minimize the movement of sand. Consequently, not only the load on the traction vehicle 11 can be reduced but also it is possible to diminish a cloud of dust.

Since a plurality of rotors 39 are arranged to match the inclination of the grating-like portion 22, even if the grating-like portion 22 is elongated to ensure the separation between waste and sand, the waste can be sent out rearwardly successively by the rotors 39 and can be held by the reticulate portion 29.

Further, since the easily-deformable elastic members 43 are provided on radially outer sides of each rotor 39, the elastic members 43 are deformed according to the size of the waste when the waste is delivered rearwardly between the rotor and the grating-like portion 22 with the rotation of the rotor 39. Thus, the waste can be delivered rearwardly without any excessive force. Particularly, in the case of delivering hard and large waste rearwardly, since the elastic members 43 are deformed and escape, it is possible to prevent stalling of the rotor 39.

Besides, since the reinforcing core member 47 is contained in each elastic member 43, the strength of the elastic member is improved.

Moreover, since each rotor 39 is provided on its radially inner sides with the rigid members 40 for supporting the elastic members 43, that is, since the elastic members 43 are supported by the rigid members 40, the strength of their base portions is sure to be improved.

Further, since the elastic member 43 is curved so that its radially outer side is positioned on a front side in the rotational direction, waste can be delivered rearwardly more positively at the time of delivering waste rearwardly through between the rotor 39 and the grating-like portion 22.

Additionally, since each rotor 39 is installed with a small clearance with respect to the grating-like portion 22, even relatively small waste can be sent out rearwardly through between the rotor and the grating-like portion as the rotor rotates.

Further, by setting the gap spacing in the grating-like portion 22 and that in the reticulate portion 29 almost equal to each other, waste scooped up onto the grating-like portion 22 can surely be held by the reticulate portion 29.

Further, the gap spacing in the grating-like portion 22 is set at approximately 20 mm, it is possible to accurately empty cans, PET bottles and caps thereof, which form the largest number of waste items.

Further, since the support/travel portions 48, which support the recovery body 17 and are adapted to travel in contact with the sandy soil 12, are provided with ski-like portions 54 extending in the horizontal direction at the front lower portion of the recovery body 17. Since the front lower portion in the traveling direction, which is apt to sink into the sandy soil 12, is formed by the ski-like portions 54, the beach cleaner travels in surface contact with the sandy soil 12 and the surface pressure is diminished to prevent deep-sinking into the sandy soil 12 during travel. Consequently, a running resistance to the traction vehicle 11 can be decreased and the height of the recovery body 17 relative to the sandy soil 12 can be stabilized, thus permitting a great improvement of the working efficiency.

Further, since the support/travel portions 48 and 49 can be adjusted their height with respect to the mounting members 50 of the recovery body 17, even if the sinking quantity of the support/travel portions 48 and 49 vary depending on the quality of the sandy soil 12, the height of the recovery body 17 can be adjusted to a height suitable for the recovery of waste. Thus, waste can be recovered efficiently.

Figure 13:
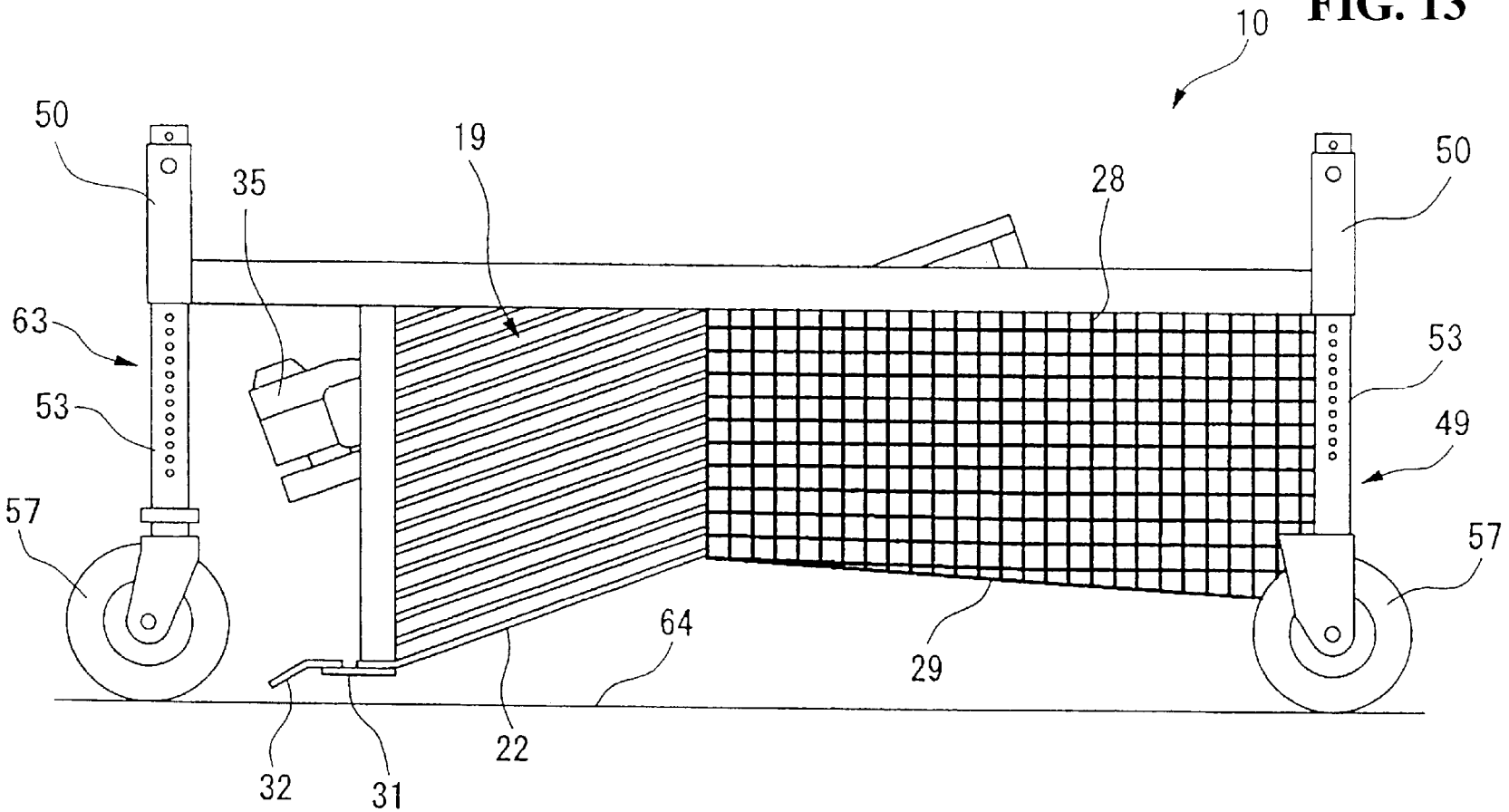
FIG. 13 is a side view showing another state of the beach cleaner according to the present invention.

Additionally, since the support/travel portions 48 and 49 can be attached to and detached from the mounting portions 50 of the recovery body 17, once the support/travel portions 48 having the ski-like portions 54 respectively are attached to the front mounting members 50, it is possible to prevent the support/travel portions 48 from sinking deeply into the sandy soil 12. On the other hand, as shown in FIG. 13, with the support/travel portions 49 of the rear mounting members 50 kept intact, if support/travel portions 63 having horizontally rotatable wheels 57 are attached to the front mounting members 50 at the lower ends of the support post portions 53 and if the height of the recovery body 17 relative to the support/travel portions 49 and 63 is adjusted so that the recovery body is positioned higher than a ground surface 64, all of the four comers are in contact with the ground surface through the wheels 57. Thus the beach cleaner is permitted to travel on any road other than the sandy soil 12. Therefore, the beach cleaner can be easily conveyed on a paved road or the like up to the sandy soil 12. Conversely, with the support/travel portions 48 of the front mounting members 50 kept intact, if the support/travel portions 48 having ski-like portions 54 are used for the rear mounting members 50, the ski-like portions 54 are present at all of four comers, thereby permitting the beach cleaner to travel on a soft sandy soil 12 or the like.

Additionally, by using members which are deformable in the front, rear, right and left directions such as the chains 15 or wires for providing a connection between the traction vehicle 1 and the beach cleaner 10, it becomes possible for only the traction vehicle 11 to retreat and also possible to improve the road surface follow-up characteristic of the beach cleaner 10. Besides, since two chains 15 are connected to the beach cleaner 10 side and are spaced in the vehicular transverse direction, it is possible to stabilize the traveling directionality of the beach cleaner 10 and it becomes possible to let the beach cleaner travel along a work line intended by the driver. Further, since the chain line is in somewhat of a downward direction toward the rear, the traction resistance decreases and it becomes possible to effect a smooth operation.

Further, since the grating-like portion 22 is inclined so that its rear side assumes an upper position, while the reticulate portion 29 is inclined so that its rear side assumes a lower position, and hence a generally triangular space is formed by the grating-like portion 22, reticulate portion 29 and sandy soil 12, sand which is scooped up together with waste by the grating-like portion 22 can be allowed to drop onto the sandy soil 12 through the gaps in the grating-like portion 22. Besides, it is possible to suppress an increase in weight of the entire beach cleaner 10 and a smooth and continuous traction work can be effected without the occurrence of stack or the like.

Figure 14:
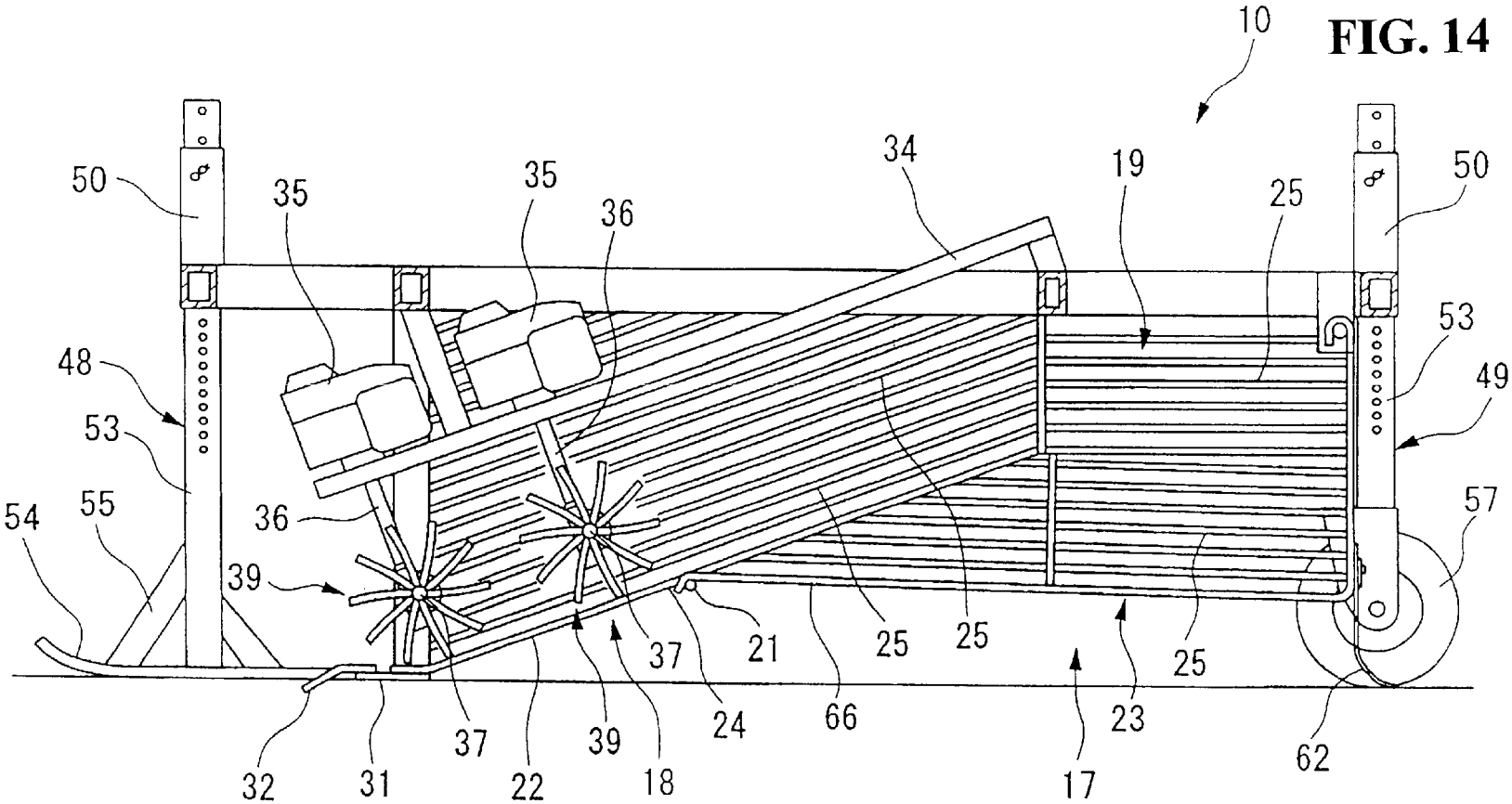
FIG. 14 is a sectional side view showing a modification of the beach cleaner according to the present invention.
Figure 15:
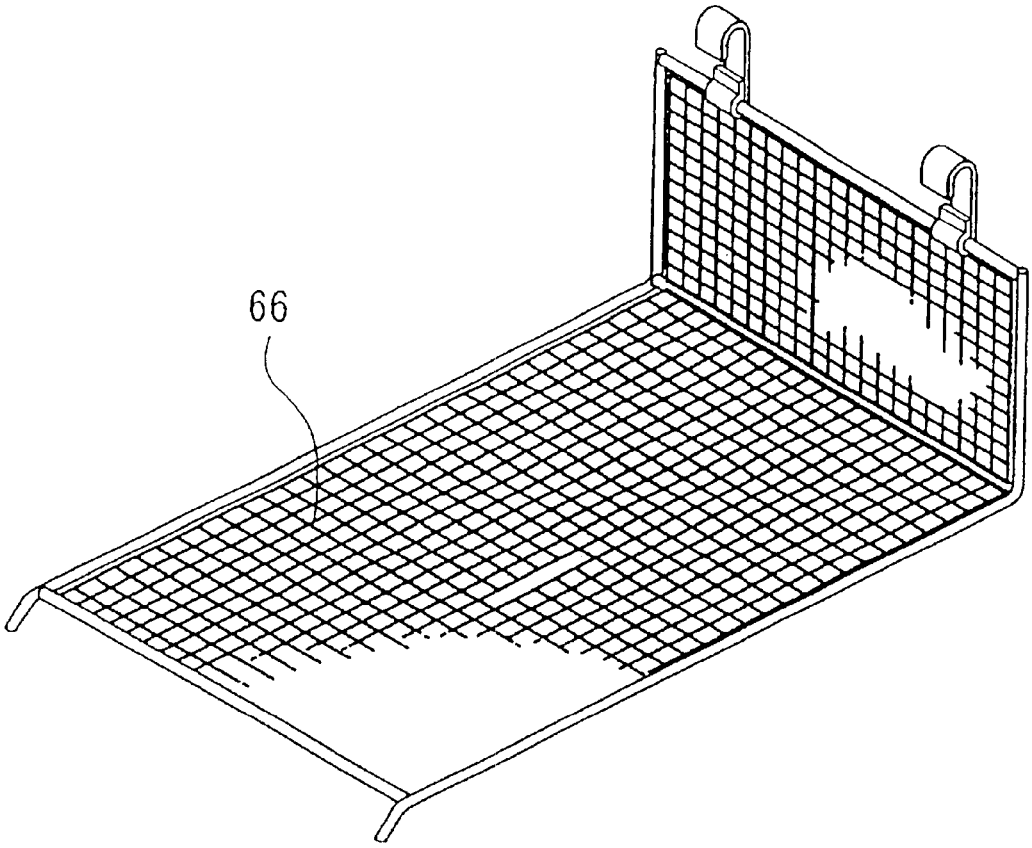
FIG. 15 is a perspective view showing a net used in the modification of the beach cleaner according to the present invention.

Without using the net 28 and in place of the rear grating-like portion 22 and rear-forming portion 20 a removable L-shaped net 66 as shown in FIGS. 14 and 15 may be used. According to this configuration, by a mere removal of the net 66, waste can be excluded at a time and thus the waste maintainability is improved.

As set forth above, according to the beach cleaner of the present invention, since it is provided with a grating-like portion which scoops up waste present in front of the beach cleaner as the beach cleaner travels and is also provided with a reticulate portion which is formed behind the grating-like portion to hold waste, when front waste is scooped up by the grating-like portion as the beach cleaner is moved in a stowed state by a traction vehicle, the waste is deposited onto the grating-like portion, while sand which is scooped up together with the waste drops through gaps in the grating-like portion. The waste thus scraped up with the grating-like portion is held with the reticulate portion which is formed behind the grating-like portion.

Thus, since only waste is held by the reticulate portion while the waste and sand are separated from each other by the grating-like portion, it is possible to reduce the size and simplify the structure of the beach cleaner. Additionally, since the portion which holds waste is formed by a reticulate portion, it is possible to reduce the amount of waste which cannot be held by the reticulate portion and then drop therefrom.

According to the beach cleaner of the present invention, since a gap in the grating-like portion is set to be similar to a gap in the reticulate portion, the waste scraped up with the grating-like portion can be held with the reticulate portion with reliability.

According to the beach cleaner described of the present invention, since the gap in the grating-like portion is set at approximately 20 mm, it is possible to accurately recover empty cans, PET bottles and caps thereof, which are the largest in number as waste.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A beach cleaner for recovering wastes while traveling in a towed state by a traction vehicle, said beach cleaner comprising:

a frame having an upper portion which is substantially rectangular in shape and disposed substantially parallel to a beach surface being cleaned;

a grating portion which scoops up wastes present in front of the beach cleaner as the beach cleaner travels; and a reticulate portion which is formed behind said grating portion to hold wastes, wherein the grating portion and the reticulate portion are suspended from transverse members of the upper portion of the frame.

2. The beach cleaner according to claim 1, wherein a gap in said grating portion is set to be similar to a gap in said reticulate portion.

3. The beach cleaner according to claim 2, wherein said gap in said grating portion is set at approximately 20 mm.

4. The beach cleaner according to claim 1, wherein a gap in said grating portion is set at approximately 20 mm.

5. The beach cleaner according to claim 1, wherein said reticulate portion includes a chamber having a lower wall, two upwardly projecting side walls and a rear wall, at least said lower wall including openings therein for enabling sand to return by gravity to the beach.

6. The beach cleaner according to claim 5, wherein said lower wall includes a plurality of rods arranged in a side-by-side relationship for trapping waste in said chamber for discharge while enabling sand to return by gravity to the beach.

7. The beach cleaner according to claim 5, wherein said lower wall, said two upwardly projecting side walls and said rear wall include a plurality of rods arranged in a side-by-side relationship for trapping wastes in said chamber for discharge while enabling sand to return by gravity to the beach.

8. The beach cleaner according to claim 5, and further including wheels mounted on a lower end of said frame for supporting said reticulate portion during movement.

9. The beach cleaner according to claim 5, wherein said upper portion of the frame is secured to said upwardly projecting side walls, and a lower portion of the frame is adjustably mounted relative to said upper portion, wherein the rear side of the reticulate portion may be adjusted by adjusting the lower portion of said frame relative to said upper portion.

10. The beach cleaner according to claim 9, wherein said lower portion includes four vertically mounted members having a plurality of apertures formed therein whereby a pin may be inserted through one of the plurality of apertures in each of said four vertically mounted members for securing said upper portion of said frame relative to said lower portion.

11. The beach cleaner according to claim 10, and further including skis mounted to lower ends of two of forwardly positioned vertically mounted members for facilitating the movement of said beach cleaner.

* * * * *